US007121814B2

(12) United States Patent
Rockwell et al.

(10) Patent No.: US 7,121,814 B2
(45) Date of Patent: Oct. 17, 2006

(54) COMPRESSOR SOUND SUPPRESSION

(75) Inventors: David M. Rockwell, Cicero, NY (US); Lee G. Tetu, Baldwinsville, NY (US)

(73) Assignee: Carrier Corporation, Syracuse, NY (US)

( * ) Notice: Subject to any disclaimer, the term of this patent is extended or adjusted under 35 U.S.C. 154(b) by 40 days.

(21) Appl. No.: 10/956,897

(22) Filed: Sep. 30, 2004

(65) Prior Publication Data

US 2006/0073028 A1 Apr. 6, 2006

(51) Int. Cl.
*F04B 39/00* (2006.01)
*F04C 18/16* (2006.01)

(52) U.S. Cl. ..... 417/312; 418/197

(58) Field of Classification Search ..... 181/403; 417/312; 418/197, 201.1
See application file for complete search history.

(56) References Cited

U.S. PATENT DOCUMENTS

| | | | | |
|---|---|---|---|---|
| 5,208,429 | A * | 5/1993 | Field | 417/312 |
| 6,488,480 | B1 * | 12/2002 | Zhong | 418/197 |
| 6,976,833 | B1 * | 12/2005 | Daniels et al. | 418/197 |
| 2004/0040331 | A1 * | 3/2004 | Ahn et al. | 62/296 |
| 2004/0065504 | A1 | 4/2004 | Daniels | |

* cited by examiner

*Primary Examiner*—Michael Koczo, Jr.
(74) *Attorney, Agent, or Firm*—Bachman & LaPointe, P.C.

(57) ABSTRACT

A compressor includes a housing and one or more working elements. A muffler is located downstream of the discharge plenum. A centerbody is located in the discharge plenum upstream of the muffler spanning a major portion of a length between a bearing case and the muffler.

13 Claims, 4 Drawing Sheets

COMPRESSOR SOUND SUPPRESSION

BACKGROUND OF THE INVENTION

The invention relates to compressors. More particularly, the invention relates to sound and vibration suppression in screw-type compressors.

In positive displacement compressors, discrete volumes of gas are: trapped at a suction pressure; compressed; and discharged at a discharge pressure. The trapping and discharge each may produce pressure pulsations and related noise generation. Accordingly, a well developed field exists in compressor sound suppression.

One class of absorptive mufflers involves passing the refrigerant flow discharged from the compressor working elements through an annular space between inner and outer annular layers of sound absorptive material (e.g., fiber batting or foam). U.S. Patent Application Pub. No. 2004/0065504 A1 discloses a basic such muffler and then improved versions having integral helmholtz resonators formed within the inner layer. The disclosure of this '504 publication is incorporated by reference herein as if set forth at length.

SUMMARY OF THE INVENTION

One aspect of the invention involves a compressor including a housing and one or more working elements. A muffler is located downstream of the discharge plenum. A centerbody is located in the discharge plenum upstream of the muffler spanning a major portion of a length between a bearing case and the muffler.

The centerbody may be downstream divergent in cross-sectional area. The centerbody may be added in a redesign or reengineering of an existing compressor configuration and/or a remanufacturing of an existing compressor previously lacking such a centerbody. During the redesign/reengineering, parameters of the centerbody may be optimized to provide a desired degree of minimized pressure drop across the discharge plenum.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
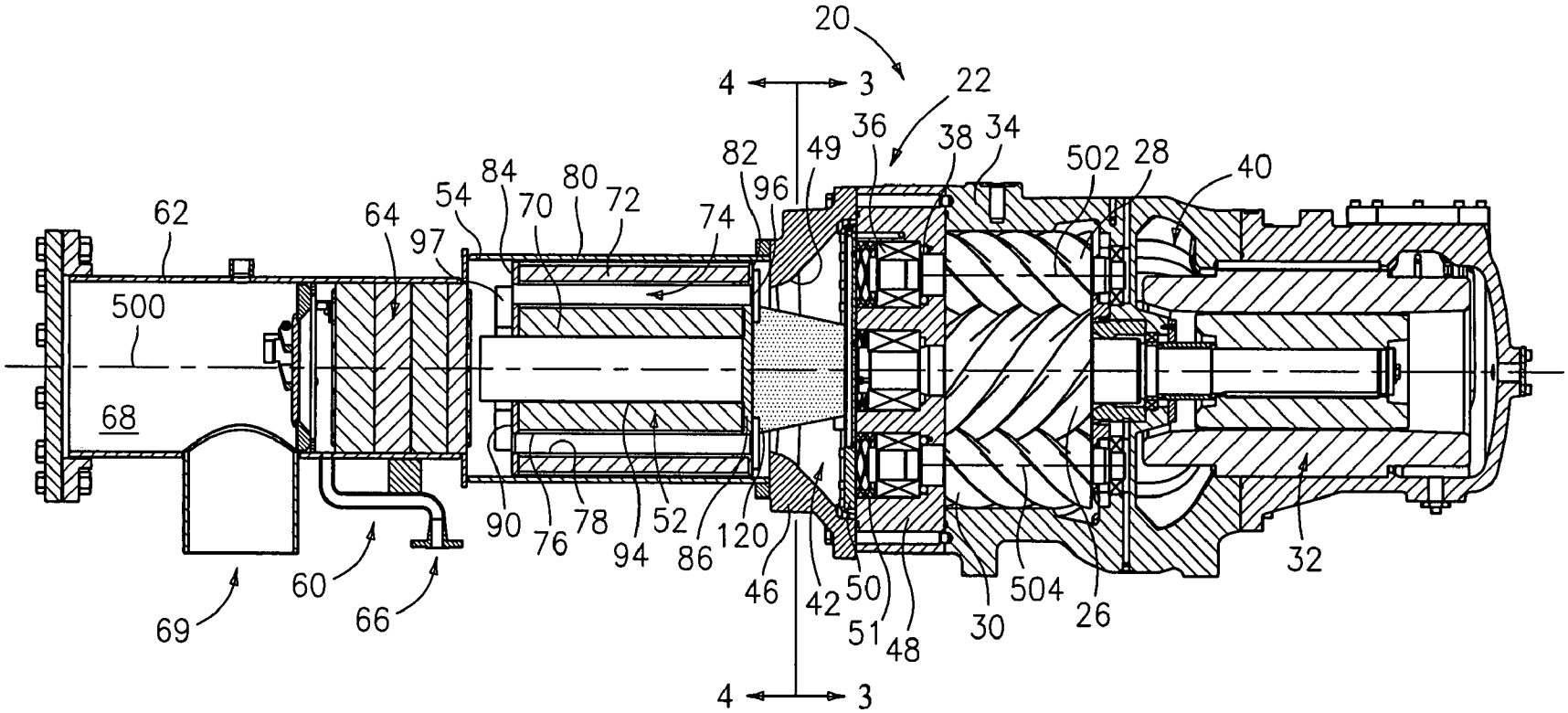
FIG. 1 is a longitudinal sectional view of a compressor.

FIG. 1 shows a compressor 20 having a housing or case assembly 22. The exemplary compressor is a three-rotor, screw-type, hermetic compressor having rotors 26, 28, and 30 with respective central longitudinal axes 500, 502, and 504. In the exemplary embodiment, the first rotor 26 is a male-lobed rotor driven by a coaxial electric motor 32 and, in turn, enmeshed with and driving the female-lobed rotors

28 and 30. In the exemplary embodiment, the male rotor axis 500 also forms a central longitudinal axis of the compressor 20 as a whole. The rotor working portions are located within a rotor case segment 34 of the case assembly 22 and may be supported by bearings 36 and sealed by seals 38 engaging rotor shafts at each end of the associated rotor working portion. When driven by the motor 32, the rotors pump and compress a working fluid (e.g., a refrigerant) along a flowpath from a suction plenum 40 to a discharge plenum 42. In the exemplary embodiment, the suction plenum 40 is located within an upstream end of the rotor case 34 and the discharge plenum is located generally within a discharge case 46 separated from the rotor case by a bearing case 48 and having a generally downstream-convergent interior surface 49. In the exemplary embodiment, a bearing cover/retainer plate 50 is mounted to a downstream end of the bearing case 48 to retain the bearing stacks. Downstream of the discharge case 46 is a muffler 52 in a muffler case 54. Downstream of the muffler 52 is an oil separator unit 60 having a case 62 containing a separator mesh 64. An oil return conduit 66 extends from the housing 62 to return oil stopped by the mesh 64 to a lubrication system (not shown). An outlet plenum 68 having an outlet port 69 is downstream of the mesh 64.

The exemplary muffler 52 includes annular inner and outer elements 70 and 72 separated by a generally annular space 74 (e.g., interrupted by support webs for retaining/positioning the inner element 70). These elements may be formed of sound absorption material (e.g., fiberglass batting encased in a nylon and steel mesh) In the exemplary embodiment, the inner element 70 is retained and separated from the space 74 by an inner foraminate sleeve 76 (e.g., nylon or wire mesh or perforated/expanded metal sheeting) and the outer element 72 is similarly separated and retained by an outer foraminate sleeve 78. In the exemplary embodiment, the outer element 72 is encased within an outer sleeve 80 (e.g., similarly formed to the sleeves 76 and 78) telescopically received within the housing 54. The sleeves 80 and 78 are joined at upstream and downstream ends by annular plates 82 and 84. In the exemplary embodiment, the upstream end of the sleeve 76 is closed by a circular plate 86 and the downstream end closed by an annular plate 90. In the exemplary embodiment, a non-foraminate central core 94 (e.g., steel pipe) extends through the inner element 70 and protrudes beyond a downstream end thereof.

In operation, compressed gas flow exits the compression pockets of the screw rotors 26, 28, 30 and flows into the discharge plenum 42. Upon exiting the compressor discharge plenum, the gas enters the muffler case 54 and flows down the annular space 74. Upon exiting the muffler the gas flow, which typically has entrained oil droplets, flows through the oil separating mesh 64. The mesh 64 captures any oil entrained in the gas and returns it to the oil management system by means of the conduit 66. The gas leaves the oil separating mesh and enters the plenum 68 and exits the outlet 69 toward the condenser (not shown).

As so far described, the compressor may be of an existing configuration although the principles of the invention may be applied to different configurations.

Figure 2:
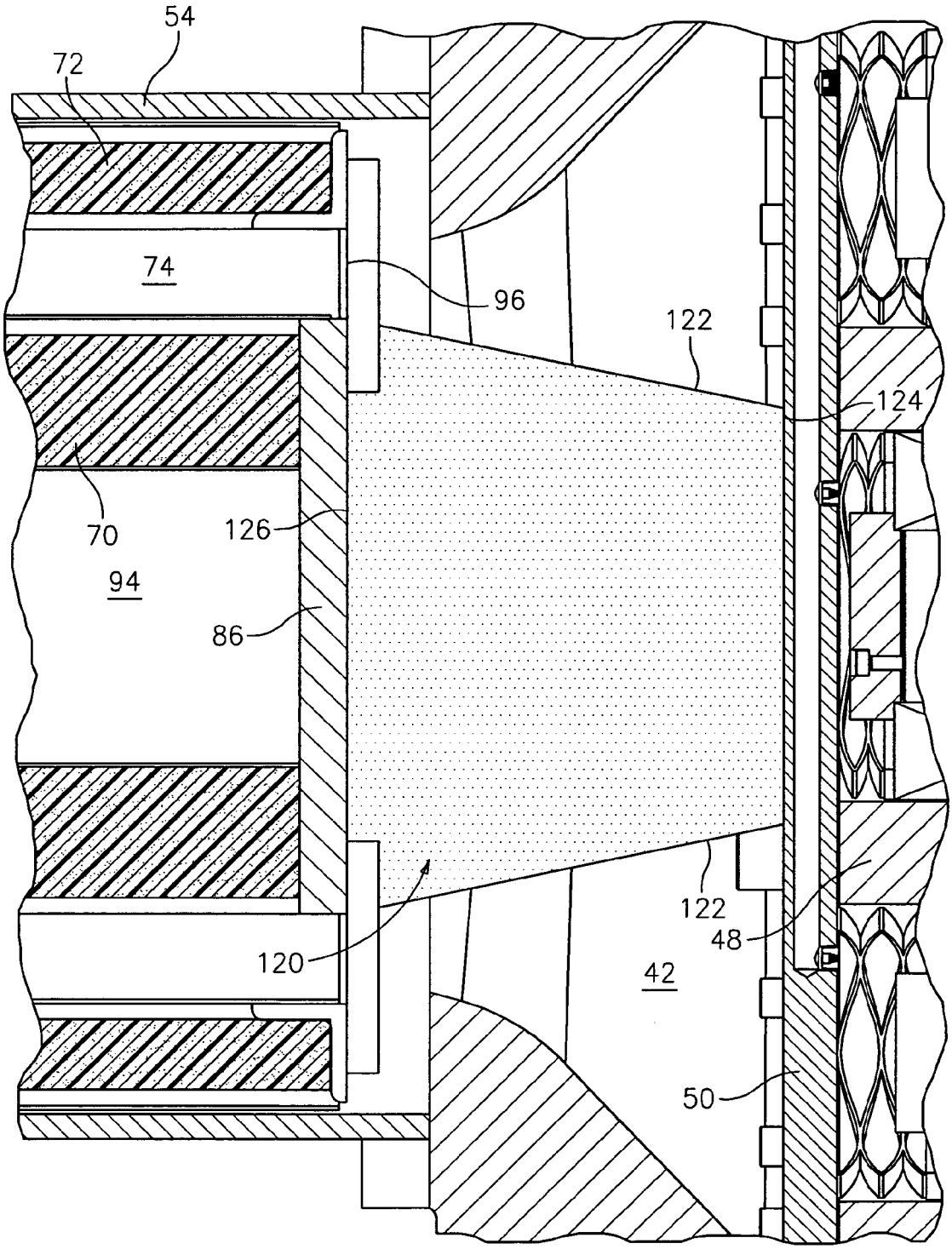
FIG. 2 is an enlarged view of a discharge plenum of the compressor of FIG. 1.

According to the present invention, a centerbody (body) 120 is positioned in the flowpath between the rotors and the muffler. FIG. 2 shows the centerbody 120 having a generally frustoconical outer surface 122 extending from a circular upstream end/face 124 to a circular downstream face 126.

Figure 3:
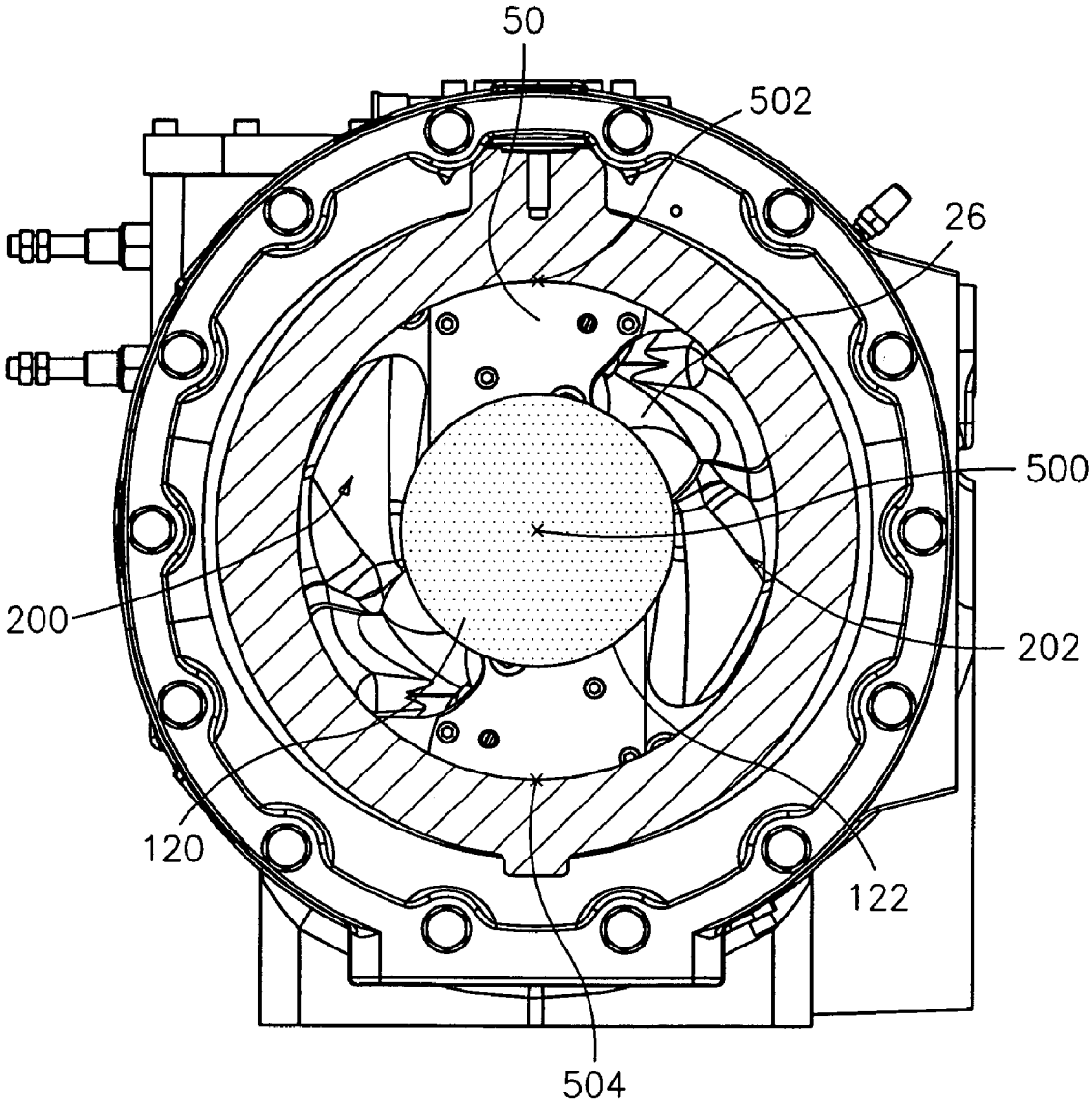
FIG. 3 is a sectional view of the compressor of FIG. 1 taken along line 3—3 of FIG. 1.
Figure 4:
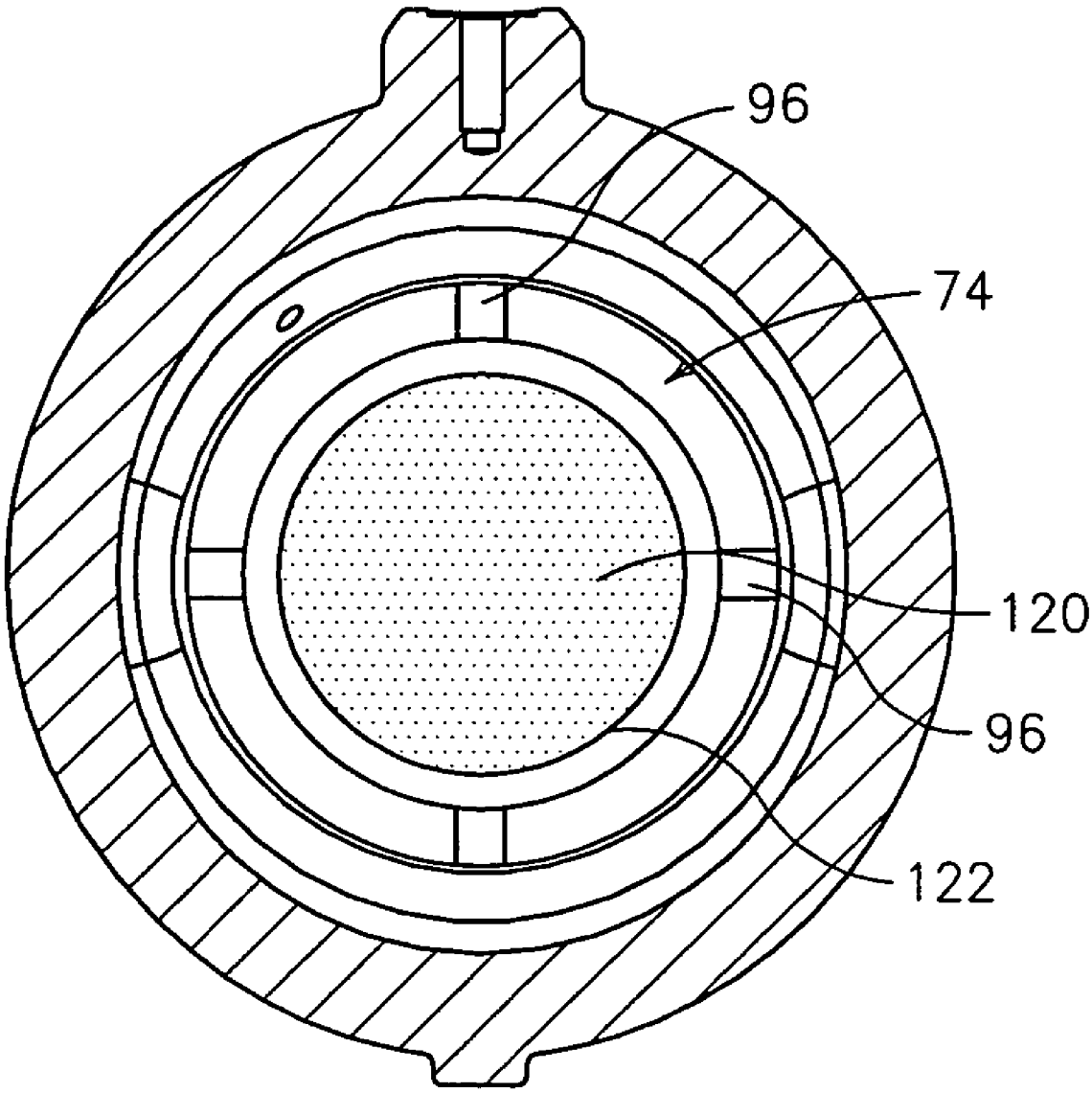
FIG. 4 is a sectional view of the compressor of FIG. 1 taken along line 4—4 of FIG. 1.

FIG. 3 shows discharge ports 200 and 202 open to the discharge plenum 42 for discharging the compressed refrigerant. The discharge ports 200 and 202 are oriented to direct the gas flow exiting the rotors to the discharge plenum 42. The ports are located at the end of the compression pocket produced by the meshing between the male and female rotors. In a two-rotor configuration, only one discharge port would be required. The ports direct the flow around cavities containing the discharge bearings 36 and seals 38. The cavities are enclosed by the bearing cover 50.

Various materials and techniques may be used to manufacture the centerbody. The centerbody may consist essentially of at least one of molded plastic (e.g., non-foam polypropylene or glass-filled nylon) or of polymeric foam or expanded bead material (e.g., molded in one or more pieces or cut from one or more pieces).

In the exemplary embodiment, the overall size and shape of the centerbody are chosen to provide a smooth transition from the discharge ports to the muffler. Accordingly, the upstream/front face 124 is sized to correspond to the inboard contours of the ports 200 and 202 defined by the plate 50. This may be at a radius essentially equal to the root radius of the working portion of the rotor 26. Similarly, the downstream/aft face 126 may be dimensioned correspondingly to the inner element of the muffler (e.g., having a similar outer radius).

The engineering and/or optimization of the centerbody may be undertaken at a variety of levels from basic to detailed and may involve a variety of theoretical/simulation and/or practical/experimentation steps. Pressures and differences may be calculated and/or measured (e.g., between upstream and downstream ends of the discharge plenum, between the upstream end of the discharge plenum and a location along or downstream of the muffler, and the like). Sounds may be measured (e.g., external or internal to the discharge plenum at one or more discrete target frequencies or ranges).

For example, a first approximation centerbody size and shape may be selected based purely on geometry (e.g., muffler inner element diameter and the spacing between the bearing case ports) and a prototype built. With the prototype, one or more parameters of pressure differences and/or sound at a target speed may be measured. At least one parameter of the centerbody size and shape may be selected/varied and the one or more parameters remeasured in an iterative process to achieve a desired level of such parameters.

The centerbody may be incorporated in the remanufacturing of a compressor or reengineering of a compressor configuration. In the reengineering or remanufacturing, various existing elements may be essentially preserved.

One or more embodiments of the present invention have been described. Nevertheless, it will be understood that various modifications may be made without departing from the spirit and scope of the invention. For example, in a reengineering or remanufacturing situation, details of the existing compressor may particularly influence or dictate details of the implementation. Accordingly, other embodiments are within the scope of the following claims.

What is claimed is:

1. A compressor comprising:

a first rotor having a first rotational axis;

a second rotor having a second rotational axis and enmeshed with the first rotor;

a third rotor having a third rotational axis and enmeshed with the first rotor;

a housing containing the first, second, and third rotors and having a bearing case supporting the first, second, and third rotors;

a suction plenum within the housing;

a discharge plenum within the housing, a flowpath extending from the suction plenum downstream to the discharge plenum;

a muffler downstream of the discharge plenum; and a body within the discharge plenum and spanning a major portion of a length between the bearing case and the muffler.

2. The compressor of claim 1 wherein:

the body essentially extends from the bearing case to the muffler.

3. The compressor of claim 1 wherein:

the body is coaxial with the first rotor.

4. The compressor of claim 1 wherein:

the body has an essentially frustoconical outer surface.

5. The compressor of claim 1 wherein:

the body has an essentially downstream continuously increasing transverse cross-sectional area.

6. The compressor of claim 1 wherein:

a downstream portion of the body has a cross-sectional area at least 20% greater than an upstream portion of the body.

7. The compressor of claim 1 wherein:

the body outer surface is essentially divergent in a direction toward the muffler.

8. The compressor of claim 1 wherein:

the body consists essentially of at least one of molded plastic, polymeric foam, and expanded bead material.

9. A compressor comprising:

a housing;

a one or more working elements within the housing;

a discharge plenum in the housing downstream of the working elements and having a downstream convergent wall surface;

a muffler downstream of the discharge plenum; and means in the discharge plenum upstream of the muffler for limiting a pressure drop between an outlet of the one or more working elements and the entrance of the muffler below a pressure drop present in the absence of said means.

10. The compressor of claim 9 wherein the one or more working elements include:

a male screw rotor; and a female screw rotor enmeshed with the male screw rotor.

11. The compressor of claim 9 wherein:

the means comprises an essentially frustoconical body.

12. The compressor of claim 9 wherein:

the means is in addition to a generally downstream-convergent interior surface of the discharge plenum; and the means smoothes a flow transition between said outlet and the muffler.

13. A compressor comprising:

a housing;

a one or more working elements within the housing;

a discharge plenum in the housing downstream of the working elements;

a muffler downstream of the discharge plenum; and a central flow guide element in the discharge plenum upstream of the muffler.

* * * * *